US008302445B2

(12) United States Patent
Pawelski et al.

(10) Patent No.: US 8,302,445 B2
(45) Date of Patent: Nov. 6, 2012

(54) ROLL STAND AND METHOD FOR ROLLING A ROLLED STRIP

(75) Inventors: Hartmut Pawelski, Ratingen (DE); Hans-Peter Richter, Friedewald (DE); Ludwig Weingarten, Düsseldorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 855 days.

(21) Appl. No.: 12/227,541

(22) PCT Filed: Mar. 12, 2007

(86) PCT No.: PCT/EP2007/002124

§ 371 (c)(1),
(2), (4) Date: Nov. 20, 2008

(87) PCT Pub. No.: WO2007/134661

PCT Pub. Date: Nov. 29, 2007

(65) Prior Publication Data

US 2009/0183544 A1 Jul. 23, 2009

(30) Foreign Application Priority Data

May 23, 2006 (DE) ..... 10 2006 024 101

(51) Int. Cl.
*B21B 29/00* (2006.01)

(52) U.S. Cl. ..... 72/241.8; 72/10.4

(58) Field of Classification Search ..... 72/241.2, 72/211, 233, 247, 241.8, 245, 248, 10.1, 72/10.4, 10.6
See application file for complete search history.

(56) References Cited

U.S. PATENT DOCUMENTS

| | | | | |
|---|---|---|---|---|
| 3,318,124 | A | 5/1967 | Plaisted | |
| 6,619,086 | B1 * | 9/2003 | Ikeda et al. | 72/8.6 |
| 6,763,694 | B1 * | 7/2004 | Boulton et al. | 72/245 |
| 2002/0023473 | A1 * | 2/2002 | Harako et al. | 72/245 |
| 2005/0066698 | A1 * | 3/2005 | Tauber et al. | 72/10.7 |

FOREIGN PATENT DOCUMENTS

| | | | |
|---|---|---|---|
| DE | 44 17 274 | | 11/1995 |
| DE | 44 24 613 | | 1/1996 |
| EP | 0 555 882 | | 8/1993 |
| EP | 1 044 737 | | 10/2000 |
| GB | 1 237 287 | | 6/1971 |
| GB | 2411140 | A * | 8/2005 |
| JP | 57 011710 | | 1/1982 |
| JP | 57 124515 | | 8/1982 |
| JP | 05 329520 | | 12/1993 |
| UA | 62598 | | 12/2003 |
| UA | 90649 | | 5/2010 |

* cited by examiner

*Primary Examiner* — Dana Ross
*Assistant Examiner* — Matthew G Katcoff
(74) *Attorney, Agent, or Firm* — Lucas & Mercanti, LLP; Klaus P. Stoffel

(57) ABSTRACT

The invention relates to a roll stand and a method for rolling a rolled strip. The roll stand (100) comprises at least one roller housing on the drive side (AS) and one roller housing on the control side (BS) of the roll stand. It also comprises bending devices which are each firmly connected to spars (2) of the roll stands for treating and bending an upper and/or lower work roller of the roll stand (100) relative to the roller housings. The bending devices and thus the work rollers are controlled via a control device. To be able to control or regulate the bending devices and/or work rollers more precisely, and thus to improve the quality of the rolled strip after rolling, it is suggested according to the invention that a bending force strain gauge be placed appropriately for direct measurement of the actual bending force affecting the work rollers (7, 8) via the bending devices (11).

20 Claims, 4 Drawing Sheets

ROLL STAND AND METHOD FOR ROLLING A ROLLED STRIP

The invention concerns a rolling stand and a method for rolling strip, especially steel strip.

The Korean document KR 1020000063033 A discloses a rolling stand of this type and a method for the open-loop or closed-loop control of the contour of a rolled sheet. To this end, the current rolling force and the current roll bending force are evaluated.

In addition, German Early Disclosure DE 44 24 613 A1 discloses a method and a device for operating a rolling stand, in which the rolling process is used to provide a well-defined surface roughness by means of a closed-loop real-time control system. The process is automatically controlled on the basis of a comparison of a set value and an actual value with a roughness profile obtained during the on-going rolling process.

Finally, German Patent DE 44 17 274 C2 discloses a rolling stand and a method for operating it. The rolling stand comprises roll housings on the drive side and the operating side and bending devices, which are connected, on the one hand, with the roll housings and, on the other hand, with the work rolls of the rolling stand. In addition, the rolling stand comprises bending devices for moving or bending the work rolls as part of automatic control of the rolling force.

Proceeding on the basis of the prior art cited last, the objective of the invention is to refine a previously known rolling stand and a method for operating it in way that allows more precise adjustment of the bending of the work rolls.

This objective is achieved by the object of Claim 1. This object is characterized by the fact that at least one bending force strain gauge is positioned in a suitable place for direct measurement of the actual bending force exerted on the work roll by the bending devices.

The bending force as used in the context of the invention is basically the same as the so-called rolling force in the negative bending range, i.e., when the work roll is pressed against the rolled strip and when the upper back-up roll is raised.

The term rolled strip in the context of the present invention means especially a metal strip, e.g., a steel strip or a nonferrous metal strip.

The use of a bending force strain gauge in accordance with the invention allows much more precise evaluation of the sag of a work roll, since the bending force actually acting on the work roll is measured and thus is not a supposed bending force determined by conversion of the hydraulic pressure, which, due to hysteresis, cannot be directly converted to active bending.

In accordance with a first embodiment, the bending force strain gauge is mounted as a replacement for a pin in the eye of a lug of the bending device, which is designed as a piston-cylinder unit. The bending force strain gauge with the lug then forms the end of the piston-cylinder unit assigned to the work roll or to the chocks of the work roll, while its other end is connected with the roll housing.

Alternatively, the bending force strain gauge is mounted parallel to the axis or coaxially in the work roll, preferably in its neck. A separate drill hole is then needed for this purpose.

It is especially advantageous for the exact bending force made available by the bending force strain gauge to be used for automatically controlling the position of the force of the work roll in a temper rolling operation of the rolling stand, i.e., with the upper back-up roll lifted from the upper work roll.

The precise bending force made available in accordance with the invention is suitable as a measured value for both a closed-loop control operation and an open-loop control operation of the control units for actuating the bending devices.

The provision of separate closed-loop control systems for the drive side and the operating side of the rolling stand offers the advantage that flatness differences between the drive side and the operating side can be automatically corrected very precisely on the basis of the measured value of the "bending force" made available in accordance with the invention. The separate automatic control offers the possibility of adjusting not only symmetrical but also unsymmetrical roll bending by actuating, say, only the drive side or only the operating side.

Compared to separate automatic control systems, a common closed-loop control system for the drive side and the operating side offers a price advantage; of course, in this case, only symmetrical adjustment of the roll bending on the drive side and the operating side is possible, which is perfectly permissible and adequate for simple rolling applications.

The provision of a separate automatic control system on both the drive side and the operating side allows individual adjustment of the bending devices and is also of interest for testing the individual bending devices. In particular, the unsymmetrical actuation of the bending cylinders on the drive side and the operating side which is thus made possible allows better adaptation to unsymmetrical strip profiles and in the case of unsymmetrical hysteresis loops of the chocks, makes it possible to carry out a suitable compensation.

Automatic control solely on the basis of the detected bending force can be used for automatic flatness control by an oblique position correction. The oblique position correction can be made in a pure bending force control system or in a pure position control system. Direct bending force measurement in accordance with the invention combined with position measurement on the hydraulic cylinders of the bending devices advantageously allows, e.g., prepositioning of a roll gap on the basis of measured position values and a subsequent fine adjustment of the roll gap on the basis of the detected bending forces. Especially in the case of multiple-stand mills, the aforementioned combination can result in an improved threading effect of the rolling stock into the roll gap by virtue of the fact that the bending of the work roll in a rolling stand that is downstream with respect to the direction of flow of the rolling stock is adjusted according to the bending of the work roll in the preceding rolling stand.

The aforesaid combination of bending force measurement and position measurement advantageously allows cascade control systems for the individual operating units either with superior automatic bending force control and subordinate automatic position control or vice versa. An advantageous application for a cascade control system of this type is automatic control of the roughness of the surface of the rolled strip.

Alternatively to the closed-loop control of the rolling stand that has been discussed so far, the rolling stand can also be operated under open-loop control. The control unit is then designed as an open-loop control unit and then operates the work rolls, e.g., with a set bending force. An evaluation unit then compares the preassigned set bending force with the actual bending force measured by the bending force strain gauge. This force comparison advantageously makes it possible to draw conclusions about increased friction values that may be present or increased wear of the bending devices or the work roll chocks. It is advantageous for the evaluation unit to signal increased wear of the bending devices, i.e., the hydraulic cylinders, the associated piston rods, or the associated guides, if the result of said force comparison exceeds a predetermined threshold value.

Alternatively, the control signal in the open-loop control operation of the rolling stand can also be designed to actuate the bending devices with a predetermined force/displacement-position set hysteresis. The actual bending force and the actual position of the bending device or the hydraulic cylinder can then be determined by means of the bending force strain gauge and the position sensor, and an evaluation unit can be used to determine whether these values lie within the preassigned set hysteresis loop. Increased wear can thus be detected and can then be corrected, e.g., by changing sliding bodies.

Furthermore, the aforementioned objective of the invention is achieved by a method for operating a rolling stand. The advantages of this method of the invention are the same as the advantages cited above with respect to the claimed rolling stand.

The description is accompanied by 8 figures.

The invention is described in detail below with reference to the specific embodiments illustrated in the figures described above. In this regard, technical features that are the same are designated by the same reference numbers or letters.

The invention concerns a rolling stand for rolling a metal strip, preferably a strip composed of steel or a nonferrous metal. The rolling stand comprises two roll housings, one on the operating side and one on the drive side of the rolling stand. Two work rolls and two back-up rolls, each assigned to one of the work rolls, are rotatably supported in chocks between the roll housings. Each back-up roll can be raised vertically from or lowered vertically away from its associated work roll by means of hydraulic cylinders (see reference number 19 in FIG. 1); the rolling stand is then operated in so-called temper rolling mode.

Figure 1:
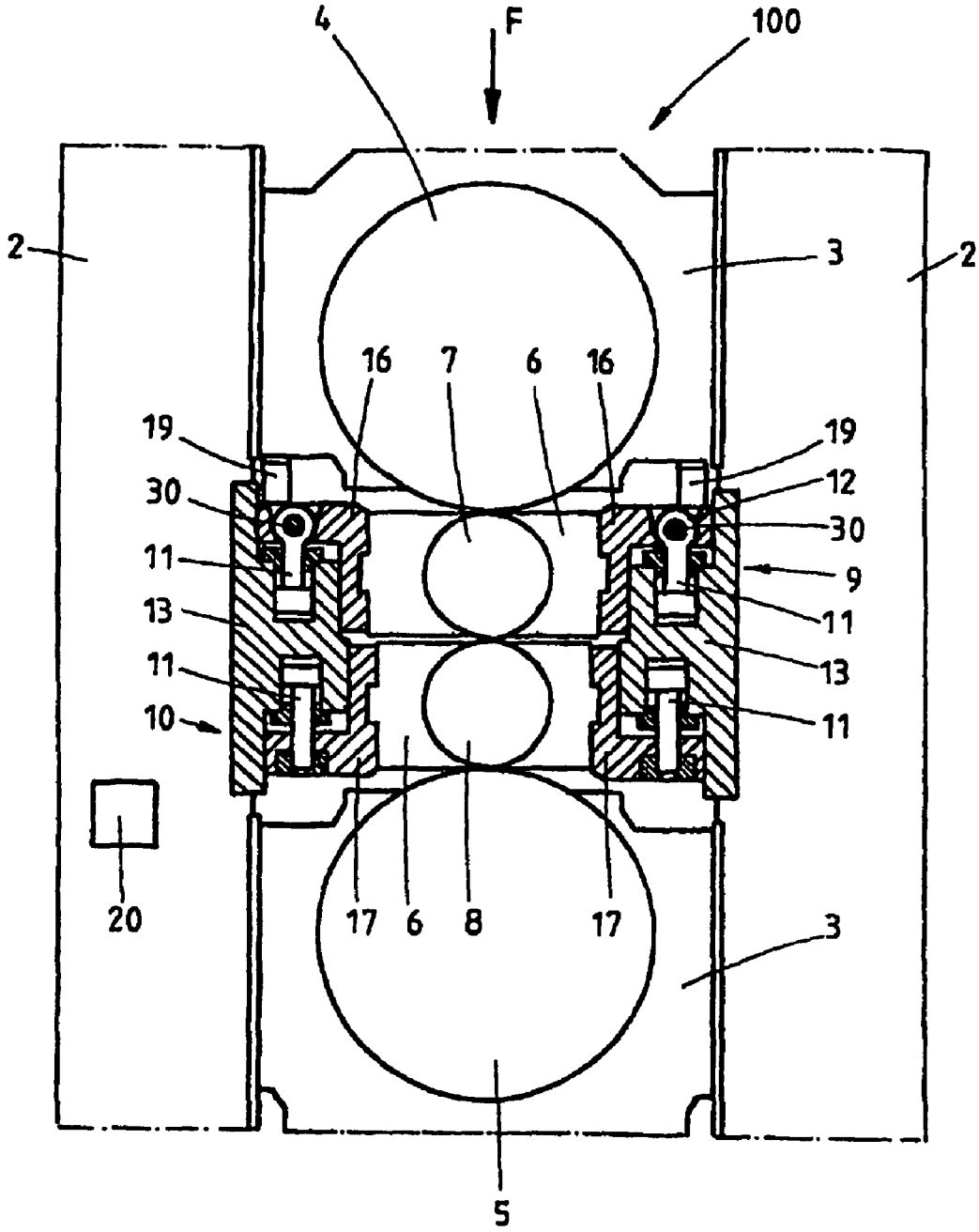
FIG. 1 shows a roll housing of a rolling stand of the invention.

According to FIG. 1, each of the work rolls 7, 8 is moved vertically relative to the direction of passage of the rolled strip by bending devices 11 in the form of hydraulic cylinders assigned to each work roll. At their end on the housing side, the hydraulic cylinders 11 are rigidly connected with the respective uprights 2 of the roll housings by bending blocks 13. At their end on the work roll side, the bending devices 11 act via guide frames 16, 17 and chocks 6 directly on the work rolls 7, 8 supported in the chocks in order to move or bend them. At their end on the work roll side, the hydraulic cylinders of the bending devices 11 are designed in the form of a lug 12 with an eye, where an articulated connection with the guide frames 16, 17 and thus indirectly with the work rolls 7, 8 is then created by a pin 30. In one embodiment of the invention, this pin is replaced by a bending force strain gauge 30 to allow an exact determination of the bending force actually acting on the work roll. This is especially important when a portion of the cylinder pressure cannot be converted to effective bending force due to hysteresis, especially friction-related hysteresis. A control unit 20 is provided for controlling the bending devices 11.

As an alternative to the embodiment illustrated in FIG. 1, the bending force strain gauge 30 can also be mounted directly in the work rolls 7, 8, in this case, axially or, ideally, coaxially to the center line of the respective work rolls, preferably in their necks.

In the following FIGS. 2 to 6, both the drive side (AS) and the operating side (BS) of the rolling stand are illustrated by two bending devices or hydraulic cylinders 11, each of which represents an upright of a roll housing. Between two uprights or between the two bending devices 11, the bending force strain gauge 30 of the corresponding roll housing is illustrated in each case.

Figure 2:
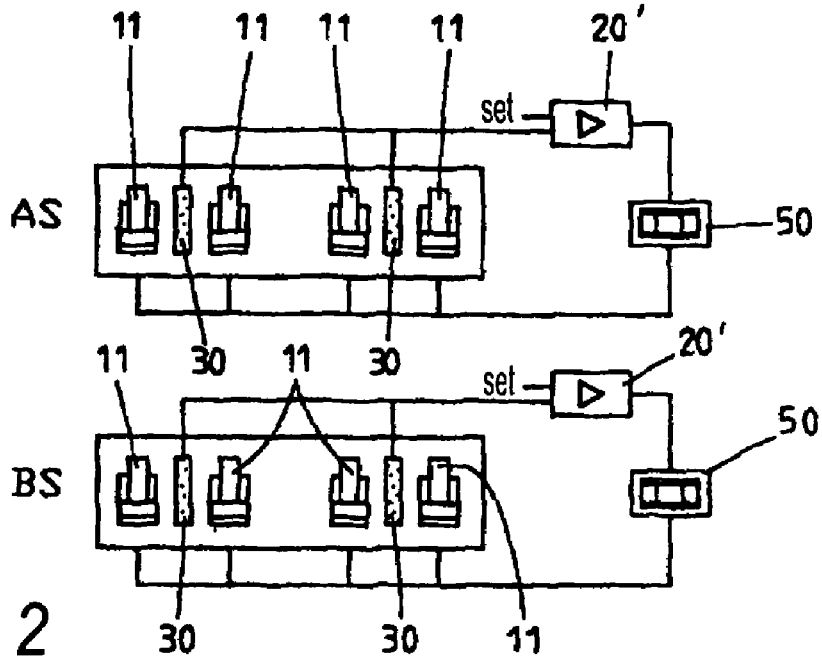
FIG. 2 shows separate closed-loop control systems for the drive side and the operating side of the rolling stand.

FIG. 2 shows a first specific example for the use of the direct bending force measurement in accordance with the invention in the individual housings of the rolling stand. The drawing illustrates separate automatic bending force control systems for the drive side (AS) and the operating side (BS) of the rolling stand 100. The actual bending force values determined by the two bending force strain gauges per side (AS, BS) are preferably averaged before they enter the automatic control system as the actual bending force. In the automatic control process, which is carried out in the control unit 20 designed as a closed-loop control unit, first a comparison is made between a predetermined set bending force and the average actual bending force to determine a control deviation. The control deviation determined in this way then serves as an actuating variable for an actuator in the form of a servovalve 50 for purely force-controlled actuation of the bending devices 11. As FIG. 2 shows, the bending devices 11 are uniformly actuated on the drive side (AS) and the operating side (BS), i.e., all of the bending devices 11 on the drive side (AS) receive the same actuating signals according to the control deviation measured on the drive side, and all of the bending devices 11 on the operating side (BS) receive the same actuating signals according to the control deviation measured on the operating side.

Figure 3:
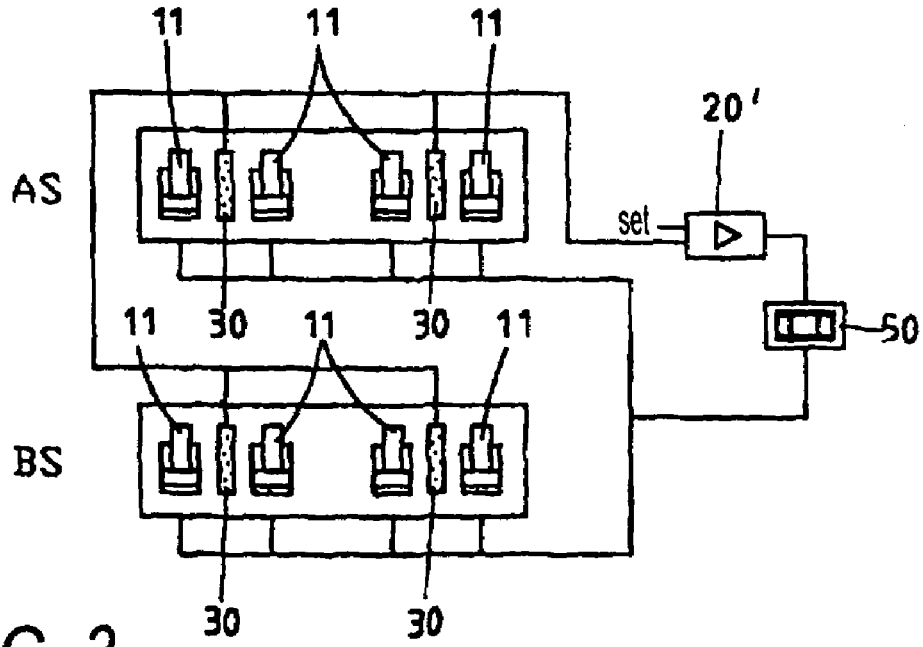
FIG. 3 shows a common closed-loop control system for the drive side and the operating side of the rolling stand.

FIG. 3 shows an alternative, second embodiment, in which only a single common closed-loop control system is provided for the drive side (AS) and the operating side (BS) of the rolling stand 100. In contrast to the first embodiment, the bending forces are not averaged on the drive side only and on the operating side only, but rather the measured actual bending forces of both sides of the rolling stand are averaged to obtain a control input value. On the basis of this mean value, a control deviation is again determined, and a servovalve 50 is actuated, which then carries out a symmetrical actuation of all the bending devices 11 of the rolling stand. Although this common automatic control system for the drive side and the operating side of the rolling stand is less expensive, because only one closed-loop control unit 20' and also only one servovalve 50 have to be provided, it allows only rolling applications that do not require unsymmetrical actuation of the operating control elements on the drive side and the operating side.

Figure 4:
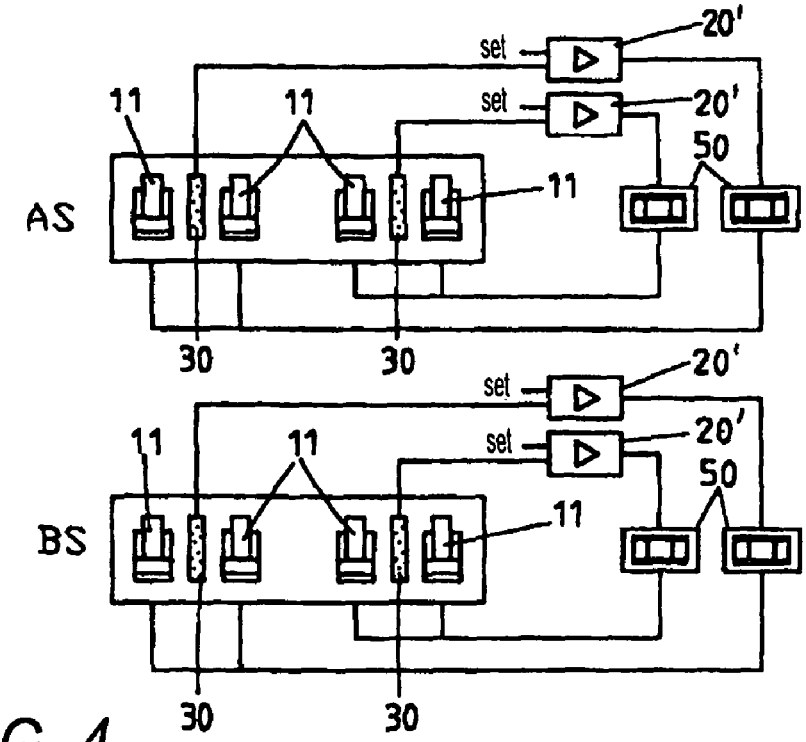
FIG. 4 shows individual closed-loop control systems for individual roll housings or for the bending devices assigned to the individual roll housings.

FIG. 4 shows a third embodiment, in which the bending force strain gauge 30 of the invention supplies actual bending force values for each individual housing, and in which these measured values are input into an automatic control unit provided for each individual housing or for each individual bending device 11 assigned to each housing. The individual automatic control of the individual roll housings that is shown in FIG. 4 is especially well suited for localizing errors in the bending devices of a roll housing, when, for example, it is discovered that a predetermined set value for the bending force is not permanently set and cannot be attained by the closed-loop control unit 20', but when a control deviation different from zero permanently remains.

Figure 5:
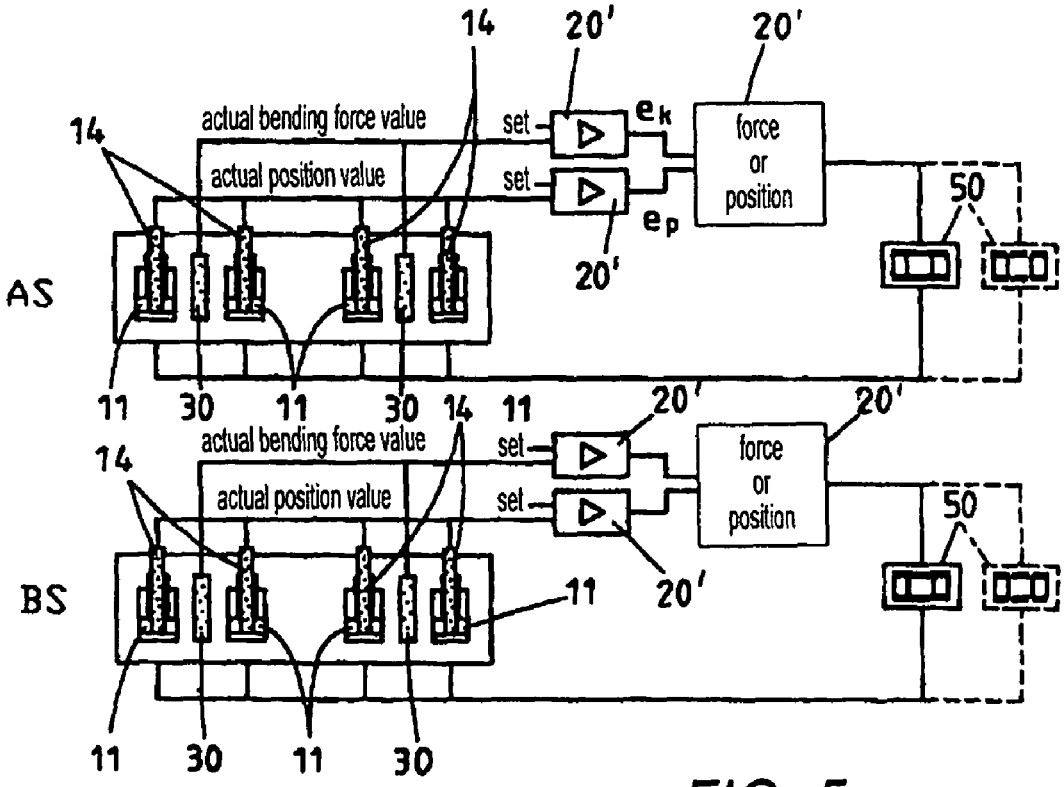
FIG. 5 shows combined automatic bending force-position control systems, by way of example, separately for the drive side and the operating side of the rolling stand.

FIG. 5 shows a combined bending force-cylinder position control system, by way of example, separately for the drive side and the operating side of the rolling stand 100. In contrast to the pure bending force control shown in FIG. 2 for each side of the rolling stand, in the automatic control system shown in FIG. 2, in addition to the separate evaluation of the bending force on each side, an evaluation of the actual positions of the hydraulic cylinders of the bending devices 11, as determined by position sensors 14, is also carried out. The measured actual positions of all cylinders are averaged for each side and supplied to a set/actual position comparison unit within the closed-loop control unit 20'. The result of this comparison is a control deviation $e_p$ with respect to the average position of the cylinders. At the same time, analogously to FIG. 2, a control deviation $e_k$ with respect to the average bending force per side is determined. Either automatic position control or automatic bending force control then selectively takes place in the closed-loop control unit 20', whereupon the bending cylinders 11 are actuated accordingly by the servovalve 50, either position-controlled or bending force-controlled.

Figure 6:
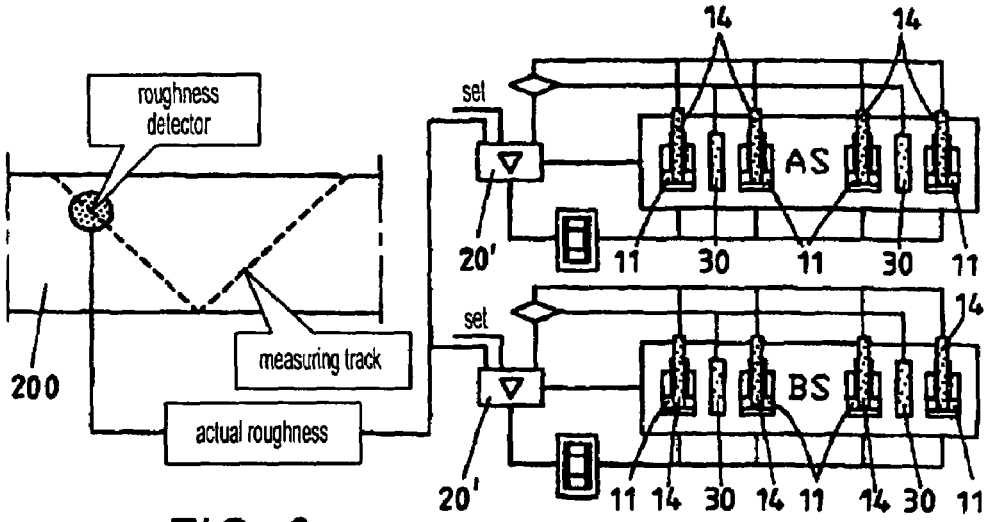
FIG. 6 shows the use of a combined automatic bending force-position control system for automatically controlling the surface roughness of a strip to be rolled.

FIG. 6 shows an advantageous embodiment for a combined automatic bending force-position control system of this type, specifically, in the form of an automatic roughness control system. As is apparent from FIG. 6, for this purpose, the surface roughness of the strip 200 to be rolled is determined by a roughness detector Ra, which moves over the rolled strip along a measuring track. The roughness detector Ra delivers a measuring signal Ist-Ra, which represents the actual roughness of the strip after the rolling process. This measuring signal is compared with a predetermined set roughness value within each of the closed-loop control units 20' for the drive side (AS) and the operating side (BS) in order to adjust the position or the bending force of the corresponding work roll according to the control deviation for the roughness that results from this comparison. This is done especially during a temper rolling operation of the rolling stand, i.e., an operation in which the back-up roll is removed from contact with its associated work roll.

A preset value on the order of, for example, 3 μm can be assigned as the set roughness. To realize this set roughness on the surface of the rolled strip 200, it is necessary for the work roll to press with a certain force everywhere on the surface of the rolled strip. This means that to realize the desired roughness on the surface of the rolled strip, it is basically necessary to provide automatic control of the bending devices 11 that is based on bending force, which ensures that, at a predetermined thickness of the rolled strip, the work roll always acts on the surface of the strip with the necessary constant bending force or rolling force. However, if the actual thickness of the rolled strip deviates from the preset thickness, automatic force control by itself would no longer be capable of holding the force constant, but rather an increase in force would occur in the case of thicker rolled strips, and a decrease in the force acting on the strip would occur in the case of thinner roller strips. However, due to the predetermined roughness that has been set, only a narrow range of force deviation of this type can be tolerated. The combination of automatic bending force and position control in accordance with the invention offers the possibility in cases of this type of reproducing the desired acting force by means of a subordinate position control system. Practically speaking, this can be done in such a way that, if the force acting on the rolled strip falls below a predetermined threshold value, because the rolled strip has a locally thinner region than the predetermined thickness, the position of the work roll can be adapted to the reduced thickness of the rolled strip as part of the subordinate automatic position control system. In practical terms, e.g., the upper work roll could then be lowered far enough that the bending force or rolling force acting on the rolled strip again exceeds the preset lower threshold value, and thus the required roughness can be realized.

Figure 8:
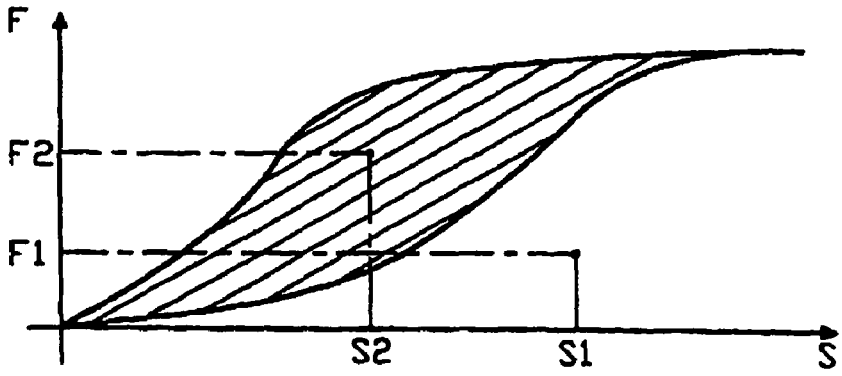
FIG. 8 shows a bending force-position hysteresis loop for a bending device for controlling a work roll.

FIG. 8 shows a mode of operation for the rolling stand that is an alternative to closed-loop control, namely, an open-loop control system, in which the control unit 20 is designed as an open-loop control unit 20". An open-loop control system of this type is suitable both for carrying out a rolling operation and for carrying out a test of the bending devices 11 with respect to their proper functioning.

To carry out a rolling operation, the control unit 20 in the form of an open-loop control unit 20" sends, e.g., a set bending force signal to the work roll, but then, in contrast to a closed-loop system, basically no check is made to determine whether a desired set bending force is also actually realized at each instant of the rolling operation.

A test of the individual bending devices can be carried out simply with the open-loop control unit 20" in such a way that the open-loop control unit 20" supplies a signal "B-Soll", which represents the set bending force, to the bending device 11, and that the bending force actually adjusted in the work roll is then subsequently detected by the bending force strain gauge 30. The bending force detected by the strain gauge 30 is then compared with the originally predetermined set bending force "B-Soll" in an evaluation unit 40. A deviation determined by this comparison between the set bending force and the actual bending force "B-Ist" can then be interpreted as increased wear of the bending blocks 13, the cylinders, or the rods of the bending devices 11 or of the bending frames 16 and 17 and the signal sent to a control station.

Figure 7:
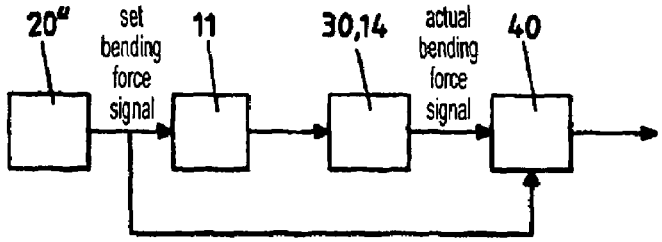
FIG. 7 shows a block diagram illustrating an open-loop control system in accordance with the invention.

This procedure is illustrated schematically in FIG. 7. As an alternative to the open-loop control with the preassignment of a set bending force that has just been described, it is also possible to realize open-loop control on the basis of a preassigned position for the bending device 11 or its hydraulic cylinder. A later comparison of the preassigned set position with the detected actual position then makes it possible to deduce a malfunction of individual elements of the bending devices 11.

FIG. 8 shows a preassigned set hysteresis loop for an individual bending device 11. In a bending device, there is in reality generally no ideal-type linear relationship between rolling force applied and position assumed or distance covered by the cylinder, but rather in reality it is always necessary to consider frictional losses, which are reflected in the hysteresis loop shown here. In this respect, the shaded hysteresis loop represents a permissible tolerance range for the relationship between force F and displacement S in a bending device 11.

The open-loop control unit 20" that has just been described with reference to FIG. 7 advantageously allows the simultaneous preassignment of a set displacement and a set force, and the downstream evaluation unit 40 makes it possible to compare these preassigned set values with bending forces and covered distances that have actually been measured for an individual bending device 11. If it is then determined in this comparison that a pair of values determined for this bending device from actual displacement S1 and corresponding measured actual bending force F1 lies outside of the shaded set hysteresis loop, it can be concluded that there is a malfunction of the bending device 11. On the other hand, if a pair of values S2, F2 is located inside the set hysteresis loop, it can be concluded that the bending device 11 is functioning properly.

The detection of the bending force independently of or in addition to the position of the cylinders of the bending device, as allowed by the bending force strain gauge 30 provided in accordance with the invention, is preferably used in cold rolling mills. This applies not only to cold rolling mills for steel but also to cold rolling mills for nonferrous metals, aluminum, copper, or copper alloys.

The invention claimed is:

1. A rolling stand (100) for rolling strip, especially metal strip, which comprises:

at least one roll housing on the drive side and at least one roll housing on the operating side of the rolling stand;

bending devices (11), which are rigidly connected with the respective roll housings for displacing and bending an upper and/or lower work roll (7, 8) of the rolling stand (100) relative to the roll housings; and a control unit (20) for controlling the bending devices (11);

wherein at least one bending force strain gauge (30) is positioned in a neck of the work roll coaxially with a center line of the work roll, for direct measurement of the actual bending force exerted on the work roll (7, 8) by the bending devices (11).

2. A rolling stand (100) in accordance with claim 1, wherein at least one of the bending devices (11) is designed as a piston-cylinder unit, which at one of its ends is directly or indirectly connected with an upright (2) of the roll housing and at its other end has a lug (12) with an eye as a suitable place for receiving a pin for direct or indirect articulated connection with the work roll, where the pin is designed in the form of the bending force strain gauge (30).

3. A rolling stand (100) in accordance with claim 1, wherein in addition, the rolling stand has an upper back-up roll (4) assigned to the upper work roll (7); and a lifting device (19) is provided for lifting the upper back-up roll (4) from the upper work roll (7) for a temper rolling operation of the rolling stand (100).

4. A rolling stand (100) in accordance with claim 1, wherein the control unit (20) is designed as a closed-loop control unit (20') for automatically controlling the bending of the work roll (7, 8) to a preassigned set bending force in response to the measured actual bending force.

5. A rolling stand (100) in accordance with claim 4, wherein the closed-loop control unit (20') has separate closed-loop control systems for the drive side (AS) and the operating side (BS) of the rolling stand for actuating the bending devices on the respective sides.

6. A rolling stand (100) in accordance with claim 4, wherein the closed-loop control unit (20') has a common closed-loop control system for the drive side (AS) and the operating side (BS) of the rolling stand for the uniform actuation of the bending devices (11) for the drive side and operating side.

7. A rolling stand (100) in accordance with claim 4, wherein the closed-loop control unit (20') for each upright (2) of the roll housing has its own closed-loop control system for adjusting the bending force in bending devices (11) assigned to the upright (2) according to the bending force measured by the bending force strain gauge (30) assigned to the roll housing (2).

8. A rolling stand (100) in accordance with claim 4, wherein a position sensor (14) is assigned to at least one of the bending devices (11) for detecting its present actual displacement position; and the closed-loop control system assigned to this bending device (11) is designed as a cascade control system for actuating the bending device with superior automatic bending force control and subordinate automatic position control or with superior automatic position control and subordinate automatic bending control.

9. A rolling stand (100) in accordance with claim 1, comprising a roughness detector (Ra) for detecting the local roughness on the surface of the rolled strip (200); and a conversion device for converting the determined local roughness or a differential roughness between a desired roughness and the detected roughness to a set bending force as an input variable for the closed-loop control unit so as to realize the desired roughness.

10. A rolling stand (100) in accordance with claim 1, wherein the control unit (20) is designed as an open-loop control unit (20") for actuating the bending devices (11) with a predetermined control signal.

11. A rolling stand (100) in accordance with claim 10, wherein the control signal is designed to preassign a set bending force for the work roll (7, 8); and an evaluation unit (40) is provided for comparing the preassigned set bending force with the actual bending force measured by the bending force strain gauge.

12. A rolling stand (100) in accordance with claim 10, wherein the control signal is designed to actuate at least one of the bending devices (11) with a predetermined bending force/displacement-position set hysteresis loop;

a position sensor (14) is provided for detecting the current actual displacement position of the bending device (11); and an evaluation unit (40) is provided to determine an actual hysteresis loop on the basis of the bending force measured by the bending force strain gauge (30) and the displacement position measured by the position sensor (14) and to compare the actual hysteresis loop of the bending device (11) with the set hysteresis loop.

13. A method for operating a rolling stand (100) for rolling a strip (200), where the rolling stand has at least one roll housing on the drive side (AS) and one roll housing on the operating side (BS) of the rolling stand and bending devices (11) for displacing and bending an upper and/or a lower work roll (7, 8), which is supported between the roll housings, relative to the roll housings;

wherein during the operation of the rolling stand (100), the actual bending force acting directly on the work roll (7, 8), which represents the bending of the work roll (7, 8), is measured at a neck of the work roll with a strain gauge coaxial with a center line of the work roll, and evaluated.

14. A method in accordance with claim 13, wherein the directly measured actual bending force is used for automatically controlling the bending of the work roll (7, 8).

15. A method in accordance with claim 14, wherein the actual bending forces are separately measured on the drive side (AS) and on the operating side (BS) and are then averaged to obtain an average actual bending force signal; and the symmetrical bending devices (11) on the drive side and the operating side are actuated to automatically control the bending force to a uniform set bending force with an equal control signal according to the average actual bending force signal.

16. A method in accordance with claim 14, wherein the actual bending forces on the drive side (AS) and on the operating side (BS) are measured separately; and the bending devices (11) on the drive side and the operating side are actuated with separate control signals according to the separately measured actual bending forces for the purpose of adjusting to the respective desired, possibly different, set bending forces.

17. A method in accordance with claim 14, comprising individual automatic control of the at least one bending device assigned to one of the roll housings (2) to the desired set bending force in response to an actual bending force of the work roll that is individually measured in the vicinity of the same roll housing.

18. A method in accordance with claim 14, wherein in at least one of the bending devices (11), besides the actual bending force, the current actual displacement position is also determined in each case; and this bending device (11) is automatically controlled with a cascade control system, in which either automatic bending force control is superior and automatic position control is subordinate or vice versa.

19. A method in accordance with claim 13, wherein the bending device (11) is actuated with a preassigned set bending force of a bending force/position set hysteresis loop;

the measured actual bending force or bending force/position actual hysteresis loop that then develops in the work roll (7, 8) is compared with the preassigned set bending force or bending force/position set hysteresis loop; and the result of this comparison is evaluated with respect to a possible malfunction.

20. A method in accordance with claim 13, wherein the local surface roughness of the rolled strip (200) is detected and converted to a set bending force for the automatic bending force control system that is necessary to realize the desired roughness.

* * * * *